US007309266B2

(12) United States Patent
Botsaris et al.

(10) Patent No.: US 7,309,266 B2
(45) Date of Patent: Dec. 18, 2007

(54) PERSONAL WATERCRAFT WINTERIZING AND FLUSH KIT

(76) Inventors: Michael Botsaris, 8561 Brad Ct., Pasadena, MD (US) 21122; Jason Parrott, 423 Auds La., Pasadena, MD (US) 21122

( * ) Notice: Subject to any disclaimer, the term of this patent is extended or adjusted under 35 U.S.C. 154(b) by 25 days.

(21) Appl. No.: 11/335,799

(22) Filed: Jan. 19, 2006

(65) Prior Publication Data

US 2006/0162902 A1 Jul. 27, 2006

Related U.S. Application Data

(60) Provisional application No. 60/646,064, filed on Jan. 22, 2005.

(51) Int. Cl.
*B63B 13/00* (2006.01)

(52) U.S. Cl. ..... 440/88 N

(58) Field of Classification Search ..... 440/88 N
See application file for complete search history.

(56) References Cited

U.S. PATENT DOCUMENTS 4,121,948 A * 10/1978 Guhlin ..... 134/100.1
5,295,880 A * 3/1994 Parker ..... 440/88 R
5,416,947 A * 5/1995 Jaffe ..... 15/330
5,482,483 A * 1/1996 Rice ..... 440/88 R
6,719,210 B2 * 4/2004 Clarke ..... 239/74

* cited by examiner

*Primary Examiner*—Lars A. Olson
*Assistant Examiner*—Daniel V. Venne
(74) *Attorney, Agent, or Firm*—Ober/Kaler; Royal W. Craig

(57) ABSTRACT

A portable pressurized personal watercraft (PWC) flushing and winterization system that gives consumers a simple and convenient PWC marine engine pressurized flush and winterization option. The PWC flushing system generally includes a compression tank with a manual or electric pressure-regulated pump (ac or dc) connected by coiled hose assembly through a stop valve, through a pressure regulator to the existing water-flush connection on most PWCs. The flushing and winterization system includes a flush chemical concentrate that is introduced into the tank and mixed with the proper amount of fresh water, and the tank/pump/regulator combination maintains a regulated output pressure of chemical or anti-freeze into the PWC engine. In addition to pressure-regulation, the amount of flush solution or anti-freeze is demarcated by level-indicator gradients on the tank, and visual monitoring of the operation of the device is possible through a clear hose assembly.

17 Claims, 3 Drawing Sheets

PERSONAL WATERCRAFT WINTERIZING AND FLUSH KIT

CROSS-REFERENCE TO RELATED APPLICATIONS

The present application derives priority from provisional patent application No. 60/646,064, filed Jan. 22, 2005.

BACKGROUND OF THE INVENTION

1. Field of the invention

The present invention relates to cooling system flush kits for engine winterization and, more particularly, to a portable pressurized flush kit specifically adapted for flushing the cooling system of personal watercraft (PWC) for engine winterization and corrosion protection.

2. Description of the Background

When the outside temperature falls below freezing, any residual water inside a PWC or other marine engine can result in a cracked engine block or housing, and a repair bill running to thousands of dollars. This unhappy circumstance can be avoided with routine engine maintenance, especially by winterizing a PWC engine at the end of the boating season. It is also considered regular and necessary maintenance to flush a PWC engine after each use to remove salt water and sediment and to prevent corrosion. Typically, water-cooled PWC marine engines are flushed by connecting a garden hose to a water supply and to the engine through an integrated flush kit connection installed by the manufacturer or by the owner after market. Winterization of a PWC engine often involves disconnecting various cooling water hoses and pouring anti-freeze into the cooling system via a funnel or other similar device.

There are a variety of flush kits and methods available for this purpose. For example, U.S. Pat. No. 5,350,329 to Haman issued on Sep. 27, 1994 shows a flushing system, for an outboard marine motor, that allows the flow of fluid (controlled by a valve) through a cooling jacket.

U.S. Pat. No. 6,776,677 to Knapp, Jr. issued Aug. 17, 2004 discloses an engine flushing device and a method of using this device for purging trapped water within the cooling chamber of an engine. The device includes a connector attachable to an output of a garden hose, a conduit, a shutoff valve having a shutoff gate, a fluid entry valve with a fluid entry gate, and a tube that can be attached to the intake port of the engine.

U.S. Pat. No. 5,980,342 to Logan issued Nov. 9, 1999 shows a flushing system that uses a pair of check valves in combination with each other. One check valve is attached to a circulating pump hose of the engine and another valve is attached to a hose that provides fresh water which is pumped through the engine to remove seawater residue from the inside of the engine.

U.S. Pat. No. 4,121,948 issued to Guhlin on Oct. 24, 1978 shows a universal flushing apparatus that can be mounted on boat motors of any size. This apparatus has features that allow a stream of fluid to be controlled and introduced into the cooling intake of the boat motor.

All the forgoing systems are bulky, require mounting to the boat motor, and are not practically suited for use on a PWC marine engine. It would be much more useful to provide a portable consumer-oriented device that can be taken to the PWC, and readily deployed for frequent flushing, even without the availability of a water hose. More recent devices such as shown in U.S. Pat. No. 5,482,483 to Rice, issued on Jan. 9, 1996, shows a portable flushing device for a marine engine with a reservoir for temporary water storage and a delivery system to the marine engine. Gravity is the power source for this system.

It would be greatly advantageous to provide a like system for personal watercraft (PWC), but PWC engines are different because they do not have an engine driven water pump integrated into the cooling system and require some type of pressurized flow. Marinas and PWC dealers often have large (stationery) pressurized fluid tanks and other systems for accomplishing flushing and winterizing of PWC engines, but many consumers would much rather do it themselves at the dock, at the boat ramp or in their driveway rather than trailer their PWCs to a marina or PWC dealer. This commands a more portable user-friendly approach that can easily be used for frequent flushing, as frequent as after each day's operation of the PWC, and for easy winterization at the end of the boating season. For this class of consumer, it would be greatly advantageous to provide a simple and inexpensive kit for winterizing and/or protecting a PWC's cooling system by flushing anti-freeze, fresh water or other treatment solution through the engine and cooling system while the PWC is out of the water. The kit would preferably connect to the standard flush couplings already included on most PWCs by the factory or installed after market (presently, those flush connections are designed to be attached to a standard water hose to flush fresh water through the engine and cooling system after each use).

SUMMARY OF THE INVENTION

Accordingly, it is an object of the present invention to provide a simple, inexpensive and convenient PWC engine winterization and flush kit that is portable, pressurized and easy to use.

It is another object to provide a pressurized flush kit for PWC engines that can easily be used for frequent flushing, as frequent as after each day's operation of the PWC, which flushes a measured treatment solution through the engine and cooling system while the PWC is out of the water.

It is another object to provide a pressurized flush kit for PWC engines that can easily be used for winterizing the PWC engine and cooling system, which flushes a measured amount of anti-freeze through the engine and cooling system while the PWC is out of the water.

It is still another object to provide a PWC cooling system flushing device that connects to the standard flush couplings already included on most PWCs by the factory or installed after market, which flush connections are designed to be attached to a standard water hose to flush fresh water through the engine and cooling system after each use.

It is still another object to provide a PWC cooling system flushing device that maintains a regulated output pressure (to avoid over-pressure and to maintain a more consistent flow), and which indicates the proper amount of flushing chemical to deploy, and which allows visual monitoring of the proper operation of the device through a clear hose.

According to the above-described objects, the present invention provides a simple, portable and inexpensive way to winterize and/or protect a PWC cooling system by flushing anti-freeze or other treatment solution through the engine and cooling system while the PWC is out of the water without the need for a fresh water hose. This is accomplished by a pressurized PWC engine cooling system winterization and flush kit that connects to the standard original equipment (OEM) flush connections already included on most PWCs by the factory (or installed by the user after market). Said OEM flush connections are currently designed to be attached to a standard water hose to flush fresh water through the engine and cooling system after each use. The proposed invention allows simple and convenient PWC winterization and flushing without a garden hose, using a pressurized device that is portable and easy to use. The device includes a compression tank for containing anti-freeze or flushing solution. The tank has a capacity of between two to four gallons, and a manual pump handle that engenders a pressure of between 30-50 psi internal to the tank. Alternative embodiments may employ electric pumps (ac or dc) to pressurize the tank or deliver fluid at the proper flow rate. The pressurized tank is connected to a 10 to 15 foot clear coil hose via standard hose fittings. The other end of the coil hose is connected by standard hose connect fittings to an on-off valve, which is in turn connected to a pressure regulator with a standard male hose end, which in turn can be coupled to the OEM PWC water-flush connection. The foregoing components may be sold in kit form along with optional concentrated flush treatment concentrate or solution, and a hose pincher tool for closing off the PWC engine water intake (as recommended by some manufacturers when flushing certain PWC engines). The flush treatment solution eliminates salt and inhibits corrosion of the cooling system. To winterize the PWC at the end of the boating season, anti-freeze may be substituted for the flush treatment solution.

Additional objectives, features and advantages will be apparent in the written description which follows.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENT

The present invention is a portable pressurized winterizing and flush system specifically adapted for flushing and winterizing the cooling system of a personal watercraft (PWC) with efficiency and economy.

Figure 1:
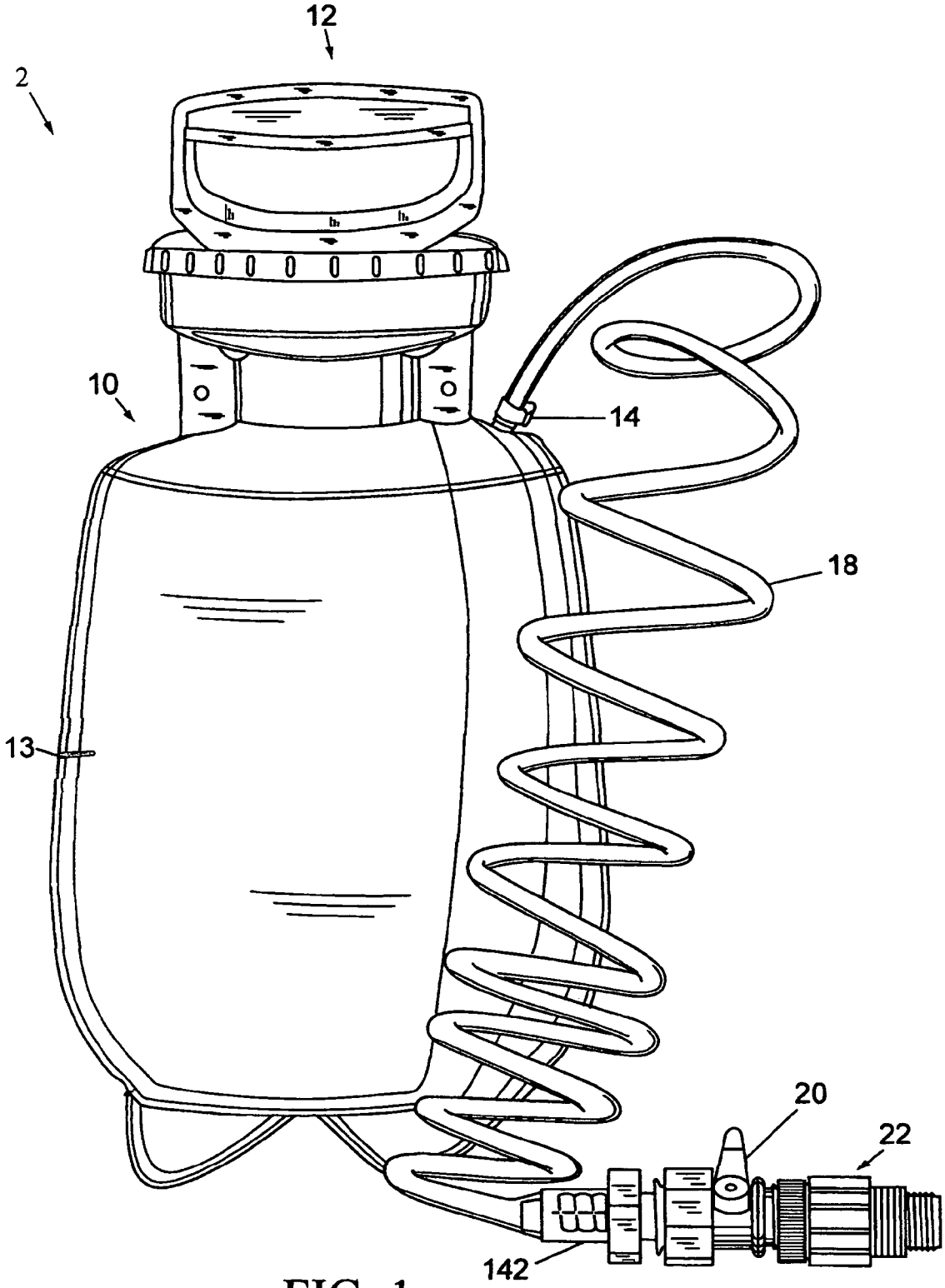
FIG. 1 is an assembled system diagram of a preferred embodiment of the PWC portable pressurized winterizing and flush system 2 according to the present invention.

FIG. 1 is an assembled system diagram of a preferred embodiment of the PWC portable pressurized winterizing and flush system 2 according to the present invention. The PWC winterizing system 2 generally includes a translucent compression tank 10 connected by coiled hose assembly 18 through a combination pressure-regulating output 22 and stop valve 20.

The compression tank 10 is preferably a translucent polyethylene holding tank with pressurization means, such as is readily available from B&G Equipment Company. One skilled in the art will understand that the tanks may alternatively be made from plastic, galvanized steel or stainless steel, though a translucent material is preferred for visual monitoring. The tank is pressurized by a screw-on cover 12 having an integral hand pump that injects a selectable pressure by pumping the handle a designated number of times. In practice, the hand pump is used to achieve a calibrated pressure in the tank of approximately 30-50 p.s.i. Thus, the tank 10 should have at least a 60 p.s.i. rating, and its capacity is preferably in the range from 2-4 gallons for present purposes. In addition, the tank 10 is demarcated with an integrally-molded fill-line 13, which should clearly indicate a fill level of one gallon of flush solution/anti-freeze. This helps to prevent over or under filling and insures the proper quantities of flush solution or anti-freeze necessary to flush a PWC engine and insures the correct amount of pressure will be created in the tank by the hand pump. One skilled in the art will readily see that the manual pump of cover 12 may be replaced by an electric pump (ac or dc) which would eliminate the need for manual pressurization.

Tank 10 also includes an integral discharge nipple (obscured) to which the hose assembly 18 is attached.

Figure 2:
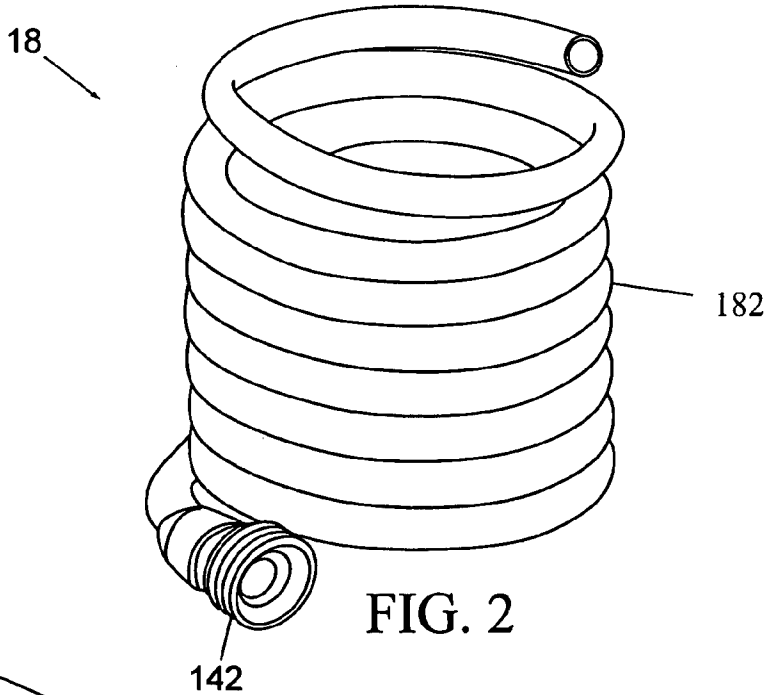
FIG. 2 shows the clear coil hose assembly 18 of FIG. 1.

FIG. 2 is an enlarged illustration of the hose assembly 18. Hose assembly 18 includes a clear pre-coiled hose section 182 attachable at one end to the tank nipple (not shown) and secured thereon by a compression ring 14 (FIG. 1). The other end of hose section 182 runs to a male screw-threaded hose coupling 142. The end of hose section 182 is preferably permanently attached onto the protruding nipple of male screw-threaded hose coupling 142 by a compression fitting (e.g., a crimped ferrule or compression ring). The outward-oriented screw-threads of hose coupling 142 provide an attachment to the stop valve 20 and combination pressure-regulating output 22 as will be described.

Figure 4:
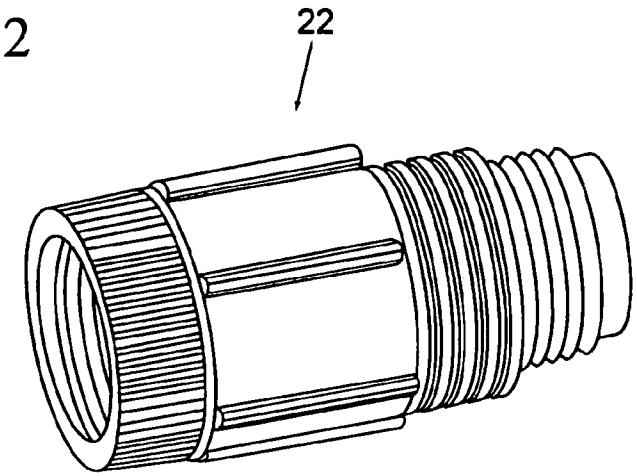
FIG. 4 shows the pressure regulator 22 of FIG. 1
Figure 3:
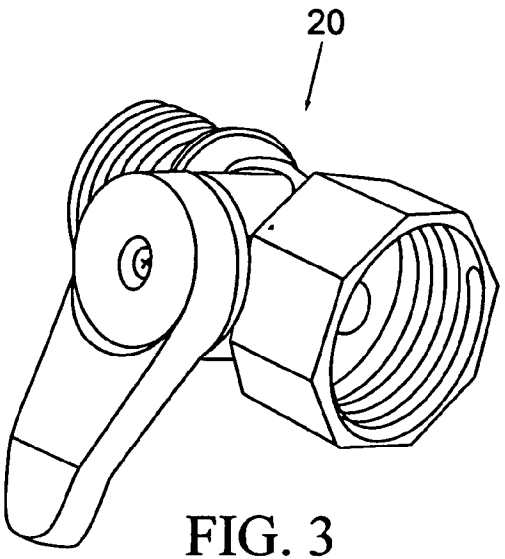
FIG. 3 shows On-Off valve 20 of FIG. 1

FIGS. 2-4 collectively show the components of the clear coil hose assembly 18 in more detail. FIG. 2 shows the clear coil hose section 182 of approximately 10 to 15 foot length and having male screw-threaded hose coupling 142 at one end. It is important that the material of coiled hose section 182 be substantially clear or translucent to allow visual monitoring of fluid flow into the PWC cooling system. The male screw-threaded hose coupling 142 at the distal end of hose section 182 connects to a stop valve 20 which in turn connects to a pressure-regulating output 22, these components collectively controlling and regulating the flow of fluid.

FIG. 3 shows stop (On-Off) valve 20, which allows maintenance of the pressure in tank 10 until ready to disburse flushing fluid or anti-freeze. The On/Off valve 20 is preferably a lever-actuated mini ball valve having female and male screw-threaded end-couplings, the female coupling being attached to the male-threaded hose coupling 142 at the distal end of hose section 182, and the male end-coupling being attached to a pressure regulator 22.

FIG. 4 shows the pressure regulator 22 having female hose thread inlet, and male hose thread outlet for screw-threaded connections inline (female-to-male flow direction). The female screw-threaded end connects to the male threads of the On-Off valve 20, while the male end connects directly to female fixture of the OEM personal watercraft fresh water flush connection (A) as shown and described below with regard to FIG. 5. Pressure regulator 22 maintains a consistent outlet fluid pressure and flow and prevents excessive pressure from damaging the PWC cooling system and hosing. A 10 p.s.i. inline pressure regulator is currently preferred to attain the desired flow rate, and a suitable pressure regulator 22 is manufactured by Hendrickson Bros., Inc. (their preset ¾" FHT×¾" MHT 10 p.s.i. regulator). It is noteworthy that the in-line order of the stop valve 20 followed by pressure-regulating output 22 should not be reversed. They must be installed in the order shown in FIG. 1 because the pressure-regulating output 22 includes a small pressure release opening that will slowly leak pressure and fluid if constant excess pressure is applied, therefore the stop valve 20 must be first in line, followed by the pressure-regulating output 22.

As previously stated the manual pump of cover 12 may be replaced by an electric pump (ac or dc) to eliminate the need for manual pressurization, and this substitution may also eliminate the need for pressure regulator 22 altogether.

It is envisioned that the above-described portable pressurized winterizing flush system 2 will be sold as a kit, inclusive of an operating manual with usage instructions (described below) and initial supply of flush chemical or concentrate and a hose pincher tool. Most any suitable marine flushing chemical or marine anti-freeze will suffice. For example, Salt Terminator™ Marine Engine Flush & Corrosion Protectant from Kwite, Inc. and Salt-Away is well suited. A bio-degradable non-toxic anti-freeze such as that manufactured by CAMCO products would also be well suited for use in the system.

The operation of the portable pressurized winterizing and flush system 2 for flushing or winterizing the cooling system of a personal watercraft (PWC) will now be described. It is important to note that every watercraft owner's manual will provide specific flushing and winterization procedures and precautions, and these should be reviewed initially.

$1^{st}$: Take the PWC out of the water and properly secure it on a trailer, stand or lift.

$2^{nd}$: Assemble the pressurized winterizing and flush system 2 (as detailed in a user's manual provided) by connecting the coiled hose assembly 18 to the tank 10, connecting the other end of hose assembly 18 to stop valve 20, and connecting the stop valve 20 to pressure-regulating output 22 (not vice versa).

$3^{rd}$: Fill the tank to fill-line 13 with 1 gallon of flush solution or 1 gallon anti-freeze. Do not over or under fill.

$4^{th}$: Fit the pump handle 12 into the compression tank 10.

$5^{th}$: Ensure that the stop valve 20 is closed, and pressurize the tank with 50 pump strokes. Do not over or under pressurize the tank 10.

$6^{th}$: Connect the free end of pressure-regulating output 22 to the watercraft flush connection.

Figure 5:
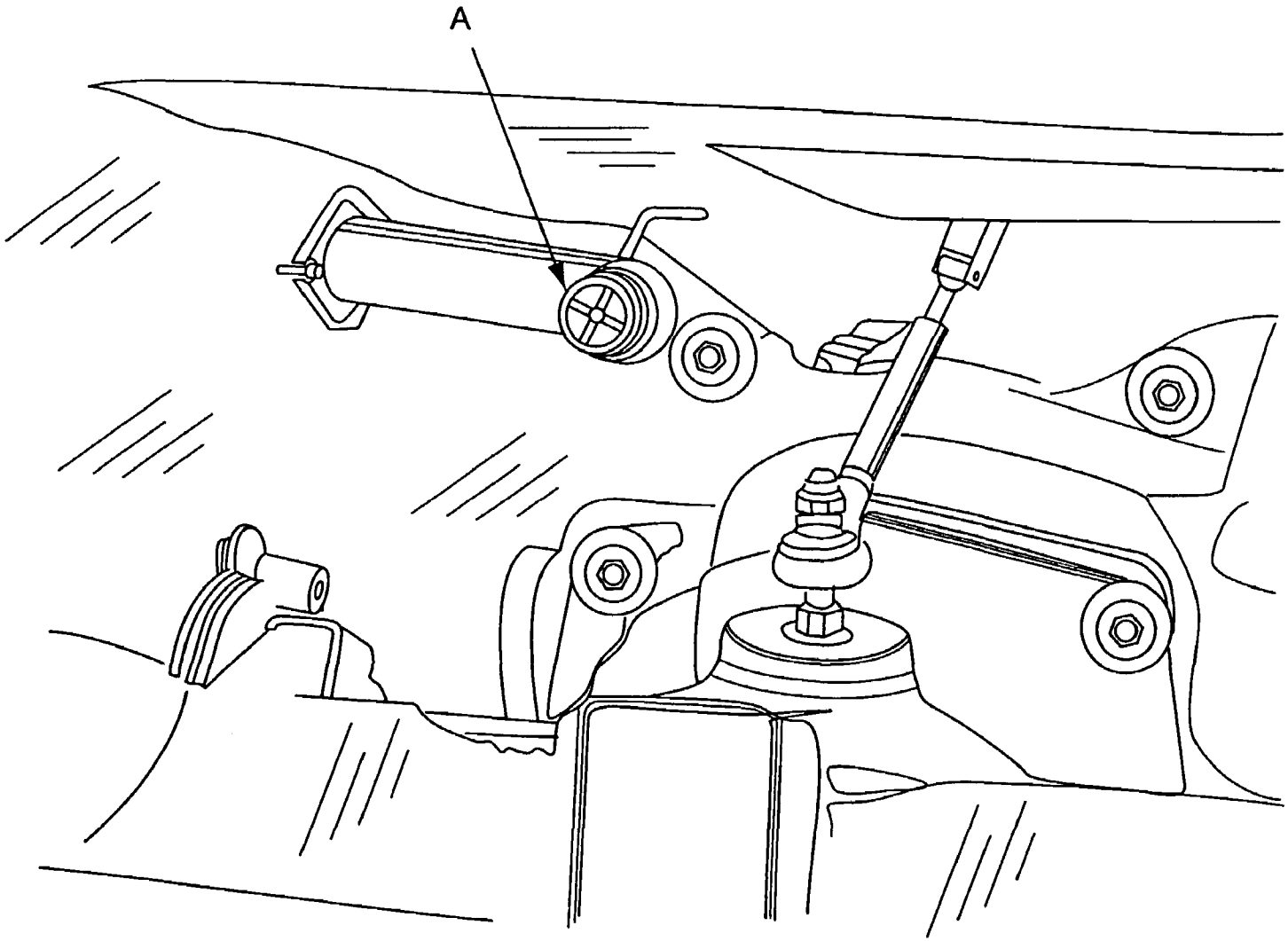
FIG. 5 is an exemplary personal watercraft fresh water flush connection (A).

FIG. 5 illustrates an exemplary PWC flush connection at (A). If recommended by the PWC owner's manual, it may be necessary to pinch off the sea water inlet hose with a hose clamp or pincher (provided in kit form). This will prevent the flush chemical solution or anti-freeze from escaping out of the sea water inlet hose during the flush operation. Initially, the stop valve 20 must remain closed. It is important not to allow fluid to flow into the watercraft cooling system if the motor is not running because serious motor damage could result.

$7^{th}$: Start the PWC engine. With the motor running at idle or at the manufacturer's recommended engine speed for flushing, open the stop valve 20 on the pressurized winterizing and flush system 2 hose assembly 18. Monitor the flow of fluid through the clear coil hose and through the PWC cooling system. If fluid is not flowing properly, turn off the valve 20, shut down the motor, and determine the cause of the problem before proceeding further. Do not allow the engine to overheat.

$8^{th}$: If fluid is flowing properly, wait approximately 40 to 60 seconds for the tank 10 to empty, shut down the motor, remove the hose pincher (if installed), and disconnect the pressure-regulating output 22 of coil hose assembly 18 from the watercraft flush connection (A).

The winterizing or flush operation is now complete. It should now be apparent that the above-described flush system gives consumers a simple and convenient PWC engine pressurized flush and winterization option that is portable, easy to use, inexpensive and connects to the standard flush couplings already included on most PWCs. This will encourage more regular and reliable flushing and winterization of PWC engines and will preserve engine life. The flushing system maintains a regulated output of the proper amount of flushing chemical or anti-freeze (by level-indicator gradient on the tank 10), and further allows visual monitoring of the proper operation of the device through clear hose assembly 18. These features, in combination, afford a convenient, quick and virtually fool-proof flushing and winterization process and procedure.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein. More particularly, a similar embodiment is envisioned using a larger tank for increased volume of flushing fluid or anti-freeze as well as increased pressurization capacity for the purposes of flushing and winterizing marine outboard motors and marine inboard motors that include similar flush connections installed by the manufacturer or aftermarket by the owner.

We claim:

1. A personal watercraft (PWC) marine engine cooling system pressure flushing and winterization system comprising:

a compression tank for containing a mixture of air and a flushing chemical, said compression tank including means for pressurizing said air; and a hose assembly for selectively discharging said flushing chemical from said compression tank at a controlled flow rate, said hose assembly including, a hose section connected at one end to said compression tank and including an opposing male screw-threaded end, a fluid on/off valve including male and female screw-threaded ends, wherein said female threaded end is attached in fluid communication with said male threaded end of said hose section, and a pressure regulator including a female threaded inlet and a male threaded outlet, wherein said female threaded inlet is attached to said male threaded end of said on/off valve, and said male threaded outlet of said pressure regulator attaches to an existing female fixture provided in said PWC attached in fluid communication with said hose section, said pressure regulator being adapted to maintain a substantially constant fluid flow rate at approximately 10 p.s.i.

2. A PWC marine engine cooling system pressure flushing and winterization system according to claim 1, wherein said compression tank comprises a translucent plastic spray tank and said means for pressurizing said air comprises a hand-compression spray pump.

3. A PWC marine engine cooling system pressure flushing and winterization system according to claim 2, wherein said compression tank is pressurized within a range of from 30-50 p.s.i. by said hand-compression spray pump.

4. A PWC marine engine cooling system pressure flushing and winterization system according to claim 3, wherein said compression tank comprises a polyethylene holding tank.

5. A PWC marine engine cooling system pressure flushing and winterization system according to claim 2, wherein said tank is demarcated with a fill-line indicating a fill of 1 gallon of flush solution or anti-freeze.

6. The PWC marine engine cooling system pressure flushing and winterization system according to claim 5, wherein said tank has a capacity in the range of 2-4 gallons.

7. A PWC marine engine cooling system pressure flushing and winterization system according to claim 1, wherein said hose section comprises a length of plastic hose.

8. A PWC marine engine cooling system pressure flushing and winterization system according to claim 7, wherein said short hose section is pre-coiled translucent plastic.

9. The PWC marine engine cooling system pressure flushing and winterization system according to claim 1, wherein said means for pressurizing said tank comprises a tank cap with integral manual hand pump for introducing a pre-determined pressure into said tank.

10. The PWC marine engine cooling system pressure flushing and winterization system according to claim 1, wherein said means for pressurizing said tank comprises a pressure-regulated electric pump.

11. The PWC marine engine cooling system pressure flushing and winterization system according to claim 8, wherein the length of said coiled hose is in the range of 10-15 feet.

12. The PWC marine engine cooling system pressure flushing and winterization system according to claim 1, wherein said fluid on/off valve further comprises a lever-actuated mini ball valve for maintaining pressure in said tank until ready to dispense flushing chemical.

13. The PWC marine engine cooling system pressure flushing and winterization system according to claim 12, wherein said pressure regulator comprises is a 10 psi pressure regulator.

14. A method for pressure flushing a cooling system of a personal watercraft (PWC) marine engine cooling system using a pressure flushing apparatus having a manual-pump compression tank containing flushing chemical, and a hose assembly including a translucent hose section connected at one end to said compression tank, and a fluid on/off valve and a pressure regulator, said method comprising the steps of:

removing a PWC from the water;

filling said compression tank with approximately 1 gallon of flushing chemical;

closing said on/off valve;

pressuring said compression tank using said pump handle;

pumping said tank a predetermined number of times to achieve a calibrated pressure in said tank within a range of from 30-50 psi;

connecting said pressure regulator to an existing watercraft engine flush coupling;

starting and operating the engine of said PWC;

opening said on-off valve;

monitoring fluid flow visually through said translucent hose section;

turning off said on-off valve;

turning off said watercraft engine.

15. A method of pressure flushing or winterizing the cooling system of a personal watereraft (PWC) marine engine cooling system according to claim 14, wherein the step of starting and operating the engine of said PWC comprises running said engine at idle.

16. A method of pressure flushing or winterizing the cooling system of a personal watercraft (PWC) marine engine cooling system according to claim 15, wherein the step of starting and operating said engine is preceded by a step of pinching off a sea water inlet hose to said PWC.

17. A method of pressure flushing or winterizing the cooling system of a personal watercraft (PWC) marine engine cooling system according to claim 14, further comprising a step of maintaining a consistent outlet fluid pressure and flow in said hose section to prevent excessive pressure from damaging the PWC cooling system and hosing.

* * * * *